US005998110A

United States Patent [19]

Faranda

[11] Patent Number: 5,998,110

[45] **Date of Patent: *Dec. 7, 1999**

[54] PHOTOGRAPHIC SILVER HALIDE DEVELOPER COMPOSITION AND PROCESS FOR FORMING PHOTOGRAPHIC SILVER IMAGES

[75] Inventor: Filippo Faranda, Savona, Italy

[73] Assignee: Ferrania S.p.A., Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,361

[22] Filed: Nov. 6, 1997

[30] Foreign Application Priority Data

Dec. 11, 1996 [EP] European Pat. Off. ..... 96119857

[51] Int. Cl.[6] ..... G03C 5/30

[52] U.S. Cl. ..... 430/436; 430/440; 430/446; 430/480; 430/483

[58] Field of Search ..... 430/434, 436, 430/440, 446, 480, 483

[56] References Cited

U.S. PATENT DOCUMENTS

| | | | |
|---|---|---|---|
| 2,688,548 | 9/1954 | Reynolds | 430/480 |
| 2,688,549 | 9/1954 | James et al. | 430/480 |
| 2,753,265 | 7/1956 | Kendall et al. | 430/480 |
| 3,039,869 | 6/1962 | Rogers et al. | 430/218 |
| 3,615,511 | 10/1971 | Cole | 430/434 |
| 3,778,267 | 12/1973 | Braunstein | 430/480 |
| 3,922,168 | 11/1975 | Restall et al. | 430/448 |
| 3,942,985 | 3/1976 | Newman et al. | 430/479 |
| 4,168,977 | 9/1979 | Takada et al. | 430/446 |
| 4,427,762 | 1/1984 | Takahashi | 430/436 |
| 4,478,928 | 10/1984 | Hess et al. | 430/217 |
| 4,650,746 | 3/1987 | Simson et al. | 430/438 |
| 4,975,354 | 12/1990 | Machonkin et al. | 430/264 |
| 4,987,060 | 1/1991 | Marchesano | 430/434 |
| 5,098,819 | 3/1992 | Knapp | 430/436 |
| 5,147,767 | 9/1992 | Knapp | 430/435 |
| 5,236,816 | 8/1993 | Purol et al. | 430/492 |
| 5,545,508 | 8/1996 | Marchesano et al. | 430/492 |

FOREIGN PATENT DOCUMENTS

| | | |
|---|---|---|
| 573700 | 12/1993 | European Pat. Off. . |
| 26 13 076 | 10/1976 | Germany . |
| 71015873 | 1/1967 | Japan . |
| 7104442 | 9/1993 | Japan . |
| 761301 | 11/1956 | United Kingdom . |
| 1531282 | 11/1978 | United Kingdom . |
| WO93 11456 | 6/1993 | WIPO . |

OTHER PUBLICATIONS

Levy, M., Superadditivity of Phenidone/Pyrogallol Developers, The Photographic Journal, 105, p. 303 (1965).

Van Veelen, G.F., J.F. Willems, The Superadditivity with Hydroquinone of Photographic Developing Agents Forming Stable Semiquinones, Photographic Science and Engineering, 12, p. 41 (1968).

*Primary Examiner*—Hoa Van Le

[57] ABSTRACT

A black-and-white aqueous alkaline photographic developer composition is described which is free of dihydroxybenzene developing agent and comprises a p-aminophenol primary developing agent and an auxiliary superadditive 3-pyrazolidone developing agent, wherein the p-aminophenol primary developing agent is represented by the following formula:

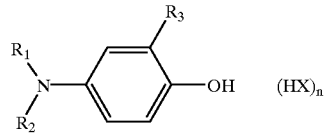

wherein $R_1$, and $R_2$, which may be the same or different, each represents a hydrogen atom, an alkyl group, or $R_1$, and $R_2$ together represent the carbon atoms required to complete a 5-membered saturated ring, $R_3$ represents a hydrogen atom, an alkyl group or an alkoxy group, n represents 0 or 1, and HX represents HCl or ½ $H_2SO_4$.

A process for forming a black-and-white photographic silver image comprising developing a silver halide photographic element with the black-and-white aqueous alkaline photographic developer composition is also described.

14 Claims, No Drawings

PHOTOGRAPHIC SILVER HALIDE DEVELOPER COMPOSITION AND PROCESS FOR FORMING PHOTOGRAPHIC SILVER IMAGES

FIELD OF THE INVENTION

The present invention refers to a photographic silver halide developer composition and to a process for forming a black-and-white images by using a developing solution which is hydroquinone-free.

BACKGROUND OF THE INVENTION

In general, the processing of black-and-white silver halide photographic elements is performed in the sequence of development, fixing and washing. Development is commonly carried out with aqueous alkaline developer compositions containing a developing agent of the dihydroxybenzene type, such as hydroquinone. Usually, dihydroxybenzene developing agents are used in combination with auxiliary superadditive developing agents. As explained in Mason, *Photographic Processing Chemistry*, Focal Press, London, 1975, "superadditivity" refers to a synergistic effect whereby the combined activity of a mixture of two developing agents is greater than the sum of two activities when each agent is used alone in the same developing solution. "Superadditivity" is especially described on pages 29 and 103 of Mason. Examples of useful auxiliary superadditive developing agents are 3-pyrazolidones, such as 1-phenyl-3-pyrazolidone (Phenidone) and 1-phenyl4,4-dimethyl-3-pyrazolidone (Dimezone), and aminophenols, such as p-methylaminophenol sulfate (Metol). Generally, the combinations of developing agents showing superadditivity consist of one developing agent from the dihydroxybenzene type (hydroquinone) and one developing agent from either the aminophenol type or the 3-pyrazolidone type. There is a case reported at page 29 of Mason in which one of the developing agent is not of the dihydroxybenzene type, that is the case of the Phenidone/Glycin system which, however, has proved of poor utility.

While development processes based on the use of hydroquinone generally provide very good sensitometric results, they are disadvantageous with regard to ecological and environmental considerations. In particular, hydroquinone and its derivatives, and the oxidized forms thereof, have become of increasing concern in recent years from the point of view of potential toxicity and environmental pollution. Thus, there is an urgent need in the art for a hydroquinone-free development process which produces the same good results as the known development process containing hydroquinone, but which is environmentally more friendly.

Developing solutions free of hydroquinone and using ascorbic acid derivatives as developing agents have been used heretofore in a wide variety of photographic developing processes. Thus, for example, developing compositions containing ascorbic acid developing agents have been disclosed in U.S. Pat. Nos. 2,688,548; 2,688,549; 3,922,168; 3,942,985; 4,168,977; 4,478,928; 4,650,746 and 4,975,354.

However, developing compositions containing ascorbic acid derivatives have poor resistance against aerial oxidation and cannot be left in continuous transport automatic processors for several days without undergoing a dramatic decrease of developing activity. Recently, several attempts have been made to increase resistance against aerial oxidation of developing compositions containing ascorbic acid derivatives as developing agents. U.S. Pat. No. 5,098,819 describes a photographic developer composition comprising a developer selected from the group consisting of ascorbic acid and its sugar-type derivatives, their salts and mixture thereof, together with a sulfite, an alkali metal carbonate and a 3-pyrazolidone developer compound.

U.S. Pat. No. 5,147,767 discloses an environmentally-safe, non-toxic non-hydroquinone and non-alkali metal hydroxide containing photographic developer composition comprising a developer selected from the group consisting of 2-keto gluconic acid and derivatives thereof, together with a sulfite, an alkali metal carbonate and a 3-pyrazolidone developer compound.

WO 93-11,456 discloses a system for rapid access processing of photographic silver halide elements comprising, in combination, a photographic silver halide element of the type containing a hydrazine compound and a developer solution comprising at least one ascorbic acid developing agent selected from the group consisting of ascorbic acid, derivatives thereof and salts of either.

U.S. Pat. No. 5,236,816 describes a photographic developing solution which is free of dihydroxybenzene developing agents, has a pH in the range of from 9.5 to 11.5 and comprises (1) and ascorbic acid developing agent, (2) an auxiliary super-additive developing agent and (3) a carbonate buffering agent in a concentration of at least 0.5 molar. The developing solution is particularly useful in a process for forming a high contrast image in the graphic arts field utilizing a silver halide photographic element comprising a hydrazine compound which functions as a nucleating agent and an amino compound which functions as an incorporated booster. The developing solution is not particularly useful when a non-nucleated film, for example a radiographic film must be developed.

EP 573,700 discloses a process for developing a silver halide photographic material in a continuous automatic way using a developer solution containing an ascorbic acid analogue or derivative and a 3-pyrazolidone derivative as developing agents and replenishing the developer solution with a replenishing composition having a defined pH.

Developing compositions containing ascorbic acid as primary developing agent have the advantage of providing an environmentally favorable alternative to the use of developing solutions containing dihydroxybenzene developing agents. However, the attempts to improve resistance to aerial oxidation of the developing compositions containing ascorbic acid derivatives as primary developing agent do not sufficiently inhibit the pH decrease of the composition. In fact, as a consequence of oxidation, a gradual pH decrease will always occur, which in turn lowers the developing activity with a dramatic decrease in sensitivity and gradation for a given constant development time, especially when said developing compositions are used in continuous transport automatic processors for several days. In addition, another disadvantage of the developing compositions is that they are useful in the graphic arts film when a high contrast image is to be obtained, but they are not useful in the radiographic field, where a high contrast image is not desired.

It is object of the present invention to provide a black-and-white developing composition, useful both in graphic arts and radiographic fields, free of dihydroxybenzene developing agent, being stable against aerial oxidation and giving very constant processing results during automatic continues processing.

SUMMARY OF THE INVENTION

The present invention relates to a black-and-white aqueous alkaline photographic developer composition, free of dihydroxybenzene developing agent, comprising a p-aminophenol primary developing agent and an auxiliary superadditive 3-pyrazolidone developing agent, wherein the p-aminophenol developing agent is represented by the formula (I):

I

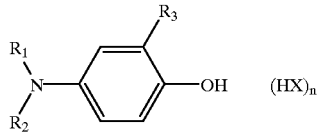

wherein $R_1$ and $R_2$, which may be the same or different, each represents a hydrogen atom, an alkyl group, or $R_1$ and $R_2$ together represent the carbon atoms required to complete a 5-membered saturated ring, $R_3$ represents a hydrogen atom, an alkyl group or an alkoxy group, n represents 0 or 1, and HX represents HCl or ½ $H_2SO_4$.

A preferred composition comprises a p-aminophenol primary developing agent present in an amount of about 0.01 to 0.8 moles per liter; an auxiliary superadditive 3-pyrazolidone developing agent present in an amount of 0.001 to 0.2 moles per liter; an inorganic antifogging agent present in an amount of 0.001 to 0.2 moles per liter; an antioxidant compound present in an amount of 0.001 to 1 moles per liter; a buffering compound present in an amount of 0.1 to 1.5 moles per liter; a sequestering agent present in an amount of 0.0001 to 0.2 moles per liter; an organic antifogging agent present in an amount of $1\times10^{-5}$ to $5\times10^{-2}$ moles per liter; an inorganic alkali agent to adjust the pH to a range of 9 to 13; and sufficient water to make one liter.

In another embodiment of the present invention a process is described using the above described black-and-white developing composition to form a silver image on a silver halide photographic film.

This black-and-white developing composition is useful both in graphic arts and radiographic fields and is more environmentally friendly due to the absence of dihydroxybenzene in the developing agent. In addition, it is stable against aerial oxidation, without decrease of the pH value during the developing composition lifetime.

DETAILED DESCRIPTION OF THE INVENTION

In the following formula (I), each of $R_1$, and $R_2$ represents a hydrogen atom, an alkyl group (including a substituted alkyl group), such as, for example, $CH_3$, $C_2H_5$, n-$C_4H_9$, n-$C_6H_{13}$, $C_2H_4OH$, $CH_2CH_2NHSO_2CH_3$, $C_4H_8OH$, or $R_1$ and $R_2$ together represent the carbon atoms required to complete a 5-membered saturated ring, such as tetrahydropyrrole ring. $R_3$ represents a hydrogen atom, an alkyl group such as those described above for $R_1$ and $R_2$, or and alkoxy group (including a substituted alkoxy group), such as, for example, $OCH_3$, $OC_2H_4OH$.

I

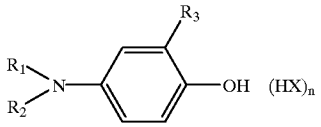

Representative examples of p-aminophenols useful in the present invention include: p-aminophenol, p-methylaminophenol sulfate (Metol), 2,4-di-aminophenol hydrochloride, 2-methyl-p-aminophenol, p-benzylaminophenol hydrochloride, and N-(beta-hydroxyethyl)-p-aminophenol. Particularly preferred among these compounds is p-methylaminophenol sulfate (Metol).

The amount of such p-aminophenol developing agent used in the present invention is from about 0.01 to 0.8 moles per liter, preferably from about 0.08 to 0.3.

The auxiliary developing agents showing a superadditive effect in combination with p-aminophenols are the 3-pyrazolidone developing agents. Preferred developing agents of this class are those represented by the following formula (II):

II

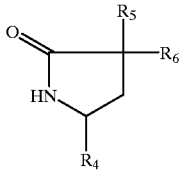

wherein $R_4$ represents a phenyl group (including a substituted phenyl group), and $R_5$ and $R_6$, which may be the same or different, each represents a hydrogen atom or an alkyl group (including a substituted alkyl group). Examples of $R_4$ include phenyl and phenyl substituted with groups such as methyl, chloro, amino, methylamino, methoxy and methylsulfonamidoethyl. Examples of $R_5$ and $R_6$ include unsubstituted alkyl groups and alkyl groups substituted with groups such as hydroxy, carboxy or sulfo. Representative examples of 3-pyrazolidones useful in the present invention include: 1-phenyl-3-pyrazolidone (Phenidone), 1-phenyl-4-methyl-3-pyrazolidone (Dimezone Z), 1-phenyl-4-methyl4-hydroxy-methyl-3-pyrazo-lidone (Dimezone S), 1-phenyl-4,4'-dimethyl-3-pyrazolidone (Dimezone), 1-phenyl4,4-dihydroxymethyl-3-pyrazolidone, 1-phenyl-4,4-diethyl-3-pyrazolidone, 1-p-chlorophenyl4-methyl-4-ethyl-3-pyrazolidone, 1-p-acetamidophenyl-4,4-diethyl-3-pyrazolidone, 1-p-hydroxyphenyl4,4-di-methyl-3-pyrazolidone, and 1-p-methoxyphenyl-4,4-diethyl-3-pyrazo-lidone.

The amount of such superadditive auxiliary developing agent used in the present invention is from about 0.001 to 0.2 moles per liter, preferably from about 0.025 to 0.1.

Preferably, the molar ratio of p-aminophenol and 3-pyrazolidone developing agents forming a superadditive mixture according to the present invention is from 4 to 10, more preferably from 6 to 8.

For the purpose of the present invention, the preferred primary developing agent is p-methylaminophenol sulfate (Metol) and the preferred superadditive auxiliary developing agent is 1-phenyl4,4-di-methyl-3-pyrazolidone (Dimezone).

Preferably, the aqueous alkaline developing compositions of this invention contain an antioxidant compound in a quantity sufficient to give good stability characteristics. Useful antioxidant compounds include the sulfite preservatives, i.e. any sulfur compound capable of forming sulfite ions in aqueous solutions, such as alkali metal or ammonium sulfites, bisulfites, metabisulfites, sulfurous acid and carbonyl-bisulfite adducts. Typical examples of sulfite preservatives include sodium sulfite, potassium sulfite, lithium sulfite, ammonium sulfite, sodium bisulfite, potassium metabisulfite, sodium metabisulfite, bisulfite-formaldehyde addition compound sodium salt, and the like.

Antifoggant agents, known in the art to eliminate fog on the developed photographic silver halide films, can be used in the developer compositions of this invention. They include, for example, organic antifoggant agents, such as derivatives of benzimidazole, benzotriazole, tetrazole, imidazole, indazole, thiazole, etc., used alone or in combination. The organic antifoggants are well known as discussed, for example, in Mees, *The Theory of the Photographic Process*, 3rd Edition, 1966, p. 344–346. Derivatives of benzotriazole are preferred in the practice of this invention, as described in EP 182,293. Suitable derivatives include lower alkyl groups (having 1 to 4 carbon atoms), lower alkoxy groups (having 1 to 4 carbon atoms) or halogen (chlorine) substituted benzotriazole antifoggant agents. Benzotriazoles, such as 5-methyl-benzotriazole, are used advantageously in combination with tetrazoles, such as 1-phenyl-5-mercapto-tetrazole.

At least an inorganic alkali agent is used in the developer compositions of this invention to achieve the preferred pH range which normally is above 10. Suitable inorganic alkali agent includes KOH, NaOH, potassium and sodium carbonate, etc.

Other adjuvants well known in the art may be incorporated in the developer compositions of this invention. These include, for example, inorganic antifogging agents such as soluble halides (e.g., KBr and NaBr) and sequestering agents such as aminopolycarboxylic acid compounds (e.g., nitrilotriacetic acid (NTA), ethylenediaminotetracetic acid (EDTA), diethylenetriaminopentacetic acid (DTPA), diaminopropanoltetracetic acid (DPTA) and ethylendiamino-N,N,N',N'-tetrapropionic acid (EDTP), α-hydroxycarboxylic acid compounds (e.g., lactic acid), dicarboxylic acid compounds (e.g. oxalic acid and malonic acid), polyphosphate compounds (e.g., sodium hexametaphosphate) or diphosphonic acid compounds (e.g., dialkylaminomethane diphosphonic acid as described in U.S. Pat. No. 4,873,180).

According to the present invention, the photographic silver halide developer composition preferably contains a buffering agent chosen among carbonate, borate and phosphate compounds, the carbonate and borate compounds being more preferred, used alone or most preferably in combination. Suitable carbonate buffering agents include, for example, sodium carbonate, potassium carbonate, sodium bicarbonate and potassium bicarbonate. Suitable borate buffering agents include, for example, boric acid, sodium borate, potassium borate, sodium tetraborate, potassium tetraborate, alkanolamine borate such as diethanolamine borate and triethanolamine borate.

The aqueous alkaline photographic developer composition of this invention can vary widely with respect to the concentration of the various ingredients included therein. Typically, the p-aminophenol developing agent is used in an amount of from about 0.010 to about 0.80 moles per liter, preferably in an amount of from about 0.08 to about 0.30 moles per liter; the 3-pyrazolidone auxiliary developing agent is used in an amount of from about 0.0001 to about 0.15 moles per liter, preferably in an amount of from about 0.0005 to about 0,01 moles per liter; the inorganic antifogging agent is used in an amount of from about 0.001 to about 0.2 moles per liter, preferably in an amount of from about 0.01 to about 0.05 moles per liter; the antioxidant compound (such as the sulfite preservative) is used in an amount of from about 0.001 to about 1 moles per liter, preferably in an amount of from about 0.08 to about 0.7 moles per liter of solution; the organic antifogging compounds are used in an amount of from about $1\times10^{-5}$ to about $5\times10^{-2}$ moles per liter, preferably in an amount of from about $5\times10^{-4}$ to about $1\times10^{-2}$ moles per liter; the buffering agents are used in an amount from about 0.20 to about 1 moles per liter and the sequestering agent is used in an amount of from about $1\times10^{-4}$ to about 0.2 moles per liter, preferably in an amount of from about $5\times10^{-3}$ to about 0.1 moles per liter.

According to the present invention, it is deemed to be significant to evaluate the stability of the developing composition of the present invention from variation of pH during the time. Generally, a developer composition can be considered to be stable when its pH is stable, i.e., does not decrease during the developing composition lifetime. In the present invention, a developer composition can be considered to be stable if its pH does not decrease with respect to the base pH when the pH is measured four times after mixing: 1) at mixing (as the base pH), 2) 24 hours after mixing, 3) 48 hours after mixing, and 4) 72 hours after mixing.

The developer composition of the present invention can be usually made as single concentrated liquid part that is then diluted with water in automatic processors by the use of a mixer, in order to have a ready-to-use solution. A method of making a concentrated alkaline photographic composition packaged in a single concentrated part to be diluted with water to form a ready-to-use solution is shown, for example, in U.S. Pat. No. 4,987,060.

The developer compositions of the present invention are useful in a process for treating a silver halide photographic element which can be used for any general black and white photography, graphic arts, X-ray, print, microfilm, color reversal (i.e., in the black and white development step of a color reversal process), and the like.

In particular, useful photographic elements which can be used in this invention are silver chloride emulsion elements as conventionally employed in forming halftone, dot, and line images usually called "lith" elements. The elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than 0.4 micrometers, more preferably lower than 0.2 micrometers. Other references to lith materials can be found in Research Disclosure 235, Item 23510, November 1983.

The developer compositions of the present invention are also useful in a process for forming high contrast silver images by development of a photographic element including a negative acting surface latent image-type silver halide emulsion layers in reactive association with a hydrazine compound and a contrast promoting agent.

The contrast promoting agent compound can be incorporated in the photographic element or in the developing solution or both in the developing solution and in the photographic element.

Preferred contrast promoting agents, which can be incorporated in the developing solution, include hydroxymethylidine group containing compounds, such as diarylmethanol compounds, as described in U.S. Pat. No. 4,693,956. Examples of diarylmethanol contrast promoting agents are methyl alcohol, benzhydrol, 1,3-butanediol, 1,4-cyclohexanediol, phenyl-methylcarbinol and the like.

Preferred contrast promoting agents, which can be incorporated in the photographic element, include diarylcarbinol compounds as described in U.S. Pat. No. 4,777,118. Examples of diarylcarbinol contrast promoting agents are benzhydrol, 4,4'-dimethoxydiphenylmethanol, 4,4'-dimethyldiphenyl-methanol, 2,2'-dibromodiphenylmethanol and the like.

Other contrast promoting agents useful for high contrast images are for examples the alkanolamine compounds comprising a hydroxyalkyl group of 2 to 10 carbon atoms and a mercapto compound, as described in U.S. Pat. No. 4,668,605 or certain trialkyl amines, monoalkyl-dialkanolamines or dialkylmonoalkanol amines, as described in U.S. Pat. No. 4,740,452. Useful contrast promoting agents also include certain amino compounds which function as incorporated booster described in U.S. Pat. No. 4,975,354. These amino compounds contain within their structure a group comprised of at least three repeating ethylenoxy units.

The amount of said contrast promoting agent is from about $10^{-4}$ to $10^{-1}$ mole per mole of silver, more preferably from about $10^{-3}$ to $5\times10^{-2}$ mole per mole of silver.

The silver halide emulsion layer includes negative acting surface latent image-type silver halide grains in reactive association with a hydrazine compound.

Preferably the hydrazine compound is incorporated into the photographic element, for example in a silver halide emulsion layer or in a hydrophilic colloidal layer, preferably a hydrophilic colloidal layer adjacent to the emulsion layer in which the effects of the hydrazine compound are desired. It can, of course, be present in the photographic element distributed between the emulsion and the hydrophilic colloidal layers, such as subbing layers, interlayers and protective layers.

Hydrazine compounds to be incorporated into the photographic element are those disclosed in GB 598,108 and in U.S. Pat. Nos. 2,419,974; 4,168,977; 4,323,643; 4,224,401; 4,272,614; 2,410,690; 4,166,742; 4,221,857; 4,237,214; 4,241,164; 4,243,739; 4,272,606; 4,311,871; 4,332,878; 4,337,634; 4,937,160 and 5,190,847 and in Research Disclosure No. 235, Nov. 1983, Item 23510 "Development nucleation by hydrazine and hydrazine derivatives".

In particular, useful photographic elements which can be processed with the developer composition of this invention for forming high contrast images contain silver halide emulsions that may be silver chloride, silver chloro-bromide, silver iodo-bromide, silver iodo-chloro-bromide or any mixture thereof. Generally, the iodide content of the silver halide emulsions is less than about 10% iodide moles, said content being based on the total silver halide. The silver halide emulsions are usually monodispersed or narrow grain size distribution emulsions, as described for examples in U.S. Pat. Nos. 4,166,742; 4,168,977; 4,224,401; 4,237,214; 4,241,164; 4,272,614 and 4,311,871. The silver halide emulsions may comprise a mixture of emulsions having different grain combinations, for example a combination of an emulsion having a mean grain size above 0.7 micrometers, as described in JP 57-58137 or a combination of two emulsions, both having a grain size below 0.4 micrometers, such as for example a first silver halide emulsion having a mean grain size of 0.1 to 0.4 micrometers and a second silver halide emulsion with particles having a mean grain volume lower than one half the particles of the first emulsion.

Silver halide photographic elements for X-ray exposures which can be processed in the developer compositions of the present invention comprise a transparent film base, such as polyethyleneterephthalate and polyethylene-naphathalate film base, having on at least one of its sides, preferably on both its sides, at least one silver halide emulsion layer.

The silver halide grains in the radiographic emulsion may be regular grains having a regular crystal structure such as cubic, octahedral, and tetradecahedral, or a spherical or irregular crystal structure, or those having crystal defects such as twin planes, epitaxialisation, or those having a tabular form, or combinations thereof.

The term "cubic grains" according to the present invention is intended to include substantially cubic grains, that is, silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The silver halide grains may be of any required composition for forming a negative silver image, such as silver chloride, silver bromide, silver chlorobromide, silver bromoiodide, silver bromochloroiodide, and the like. Particularly good results are obtained with silver bromoiodide grains, preferably silver bromoiodide grains containing about 0.1 to 15% moles of iodide ions, more preferably about 0.5 to 10% moles of iodide ions and still preferably silver bromoiodide grains having average grain sizes in the range from 0.2 to 3 $\mu$m, more preferably from 0.4 to 1.5 $\mu$m. Preparation of silver halide emulsions comprising cubic silver halide grains is described, for example, in Research Disclosure, Vol. 176, December 1978, Item 17643, Vol. 184, August 1979, Item 18431 and Vol 308, December 1989, Item 308119.

Other silver halide emulsions for radiographic elements having highly desirable imaging characteristics are those which employ one or more light-sensitive tabular grain emulsions as disclosed in U.S. Pat. Nos. 4,425,425 and 4,425,426. The tabular silver halide grains contained in the silver halide emulsion layers have an average diameter to thickness ratio (often referred to in the art as aspect ratio) of at least 2:1, preferably 3:1 to 20:1, more preferably 3:1 to 10:1, and most preferably 3:1 to 8:1. Average diameters of the tabular silver halide grains range from about 0.3 $\mu$m to about 5 $\mu$m, preferably 0.5 $\mu$m to 3 $\mu$m, more preferably 0.8 $\mu$m to 1.5 $\mu$m. The tabular silver halide grains have a thickness of less than 0.4 $\mu$m, preferably less than 0.3 $\mu$m and more preferably less than 0.2 $\mu$m.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter to thickness ratio of each grain can be calculated, and the diameter to thickness ratios of all tabular grains can be averaged to obtain their average diameter to thickness ratio. By this definition the average diameter to thickness ratio is the average of individual tabular grain diameter to thickness ratios. In practice, it is simpler to obtain an average diameter and an average thickness of the tabular grains and to calculate the average diameter to thickness ratio as the ratio of these two averages. Whatever the method used may be, the average diameter to thickness ratios obtained do not differ greatly.

In the silver halide emulsion layer containing tabular silver halide grains, at least 15%, preferably at least 25%, and, more preferably, at least 50% of the silver halide grains are tabular grains having an average diameter to thickness ratio of not less than 3:1. Each of the above proportions, "15%", "25%" and "50% " means the proportion of the total projected area of the tabular grains having an average diameter to thickness ratio of at least 3:1 and a thickness lower than 0.4 $\mu$m, as compared to the projected area of all of the silver halide grains in the layer.

As described above, commonly employed halogen compositions of the silver halide grains can be used. Typical silver halides include silver chloride, silver bromide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5 mol % silver iodide. The halogen composition of individual grains may be homogeneous or heterogeneous.

Silver halide emulsions containing tabular silver halide grains can be prepared by various processes known for the preparation of radiographic elements. Silver halide emulsions can be prepared by the acid process, neutral process or ammonia process, or in the presence of any other silver halide solvent. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions for photographic elements, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Other hydrophilic materials useful known in the art are described, for example, in Research Disclosure, Vol. 308, Item 308119, Section IX. The amount of gelatin employed in a radiographic element is such as to provide a total silver to gelatin ratio higher than 1 (expressed as grams of Ag/grams of gelatin). In particular the silver to gelatin ratio of the silver halide emulsion layers is in the range of from 1 to 1.5.

The radiographic element which can be developed with the developer composition of the present invention can be forehardened to provide a good resistance in rapid processing conducted in automatic processing machine with-out the use of hardeners in processing solutions. Examples of gelatin hardeners are aldehyde hardeners, such as formaldehyde, glutaraldehyde and the like, active halogen hardeners, such as 2,4-di-chloro-6-hydroxy-1,3,5-triazine, 2-chloro4,6-hydroxy-1,3,5-triazine and the like, active vinyl hardeners, such as bis-vinylsulfonyl-methane, 1,2-vinylsulfonyl-ethane, bis-vinyl-sulfonyl-methyl ether, 1,2-bis-vinylsulfonylethyl ether and the like, N-methylol hardeners, such as dimethylolurea, methyloldimethyl hydantoin and the like, and bi-, tri-, or tetra-vinylsulfonyl substituted organic hydroxy compounds, such as 1,3-bis-vi-nylsulfonyl-2-propanol and the like. Other useful gelatin hardeners may be found in Research Disclosure, Vol. 308, December 1989, Item 308119, Paragraph X.

The above described gelatin hardeners may be incorporated in the silver halide emulsion layer or in a layer of the silver halide radiographic element having a water-permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5% to 10% by weight of hydrophilic dispersing agent, such as the above described highly deionized gelatin, although a range of from 1% to 5% by weight of hydrophilic dispersing agent is preferred.

The gelatin hardeners can be added to the silver halide emulsion layer or other component layers of the radiographic element utilizing any of the well-known techniques in emulsion making. For example, they can be dissolved in either water or a water-miscible solvent such as methanol, ethanol, etc. and added into the coating composition for the above mentioned silver halide emulsion layer or auxiliary layers.

The silver halide emulsions can be chemically and optically sensitized by known methods.

Spectral sensitization can be performed with a variety of spectral sensitizing dyes known in the art. An example of such spectral sensitizing dyes is the polymethine dye class, including cyanines, complex cyanines, merocyanines, complex merocyanines, oxonols, hemioxonols, styryls, merostyryls and streptocyanines.

Although native UV-blue sensitivity of silver halides is usually known in the art, significant advantage can be obtained by the use of spectral sensitizing dyes, even when their principal absorption is in the spectral region to which the silver halide emulsion have their native sensitivity.

Preferably, spectral sensitizing dyes according to this invention are those which exhibit J aggregates if adsorbed on the surface of the silver halide grains and a sharp absorption band (J-band) with a bathocromic shift with respect to the absorption maximum of the free dye in aqueous solution. Spectral sensitizing dyes producing J aggregates are well known in the art, as illustrated by F. M. Hamer, *Cyanine Dyes and Related Compounds*, John Wiley and Sons, 1964, Chapter XVII and by T. H. James, *The Theory of the Photographic Process*, 4th edition, Macmillan, 1977, Chapter 8. The use of J-band exhibiting dyes allows the reduction of the well-known problem of crossover.

The silver halide emulsion layers can contain other constituents generally used in photographic products, such as binders, hardeners, surfactants, speed-increasing agents, stabilizers, plasticizers, gelatin extenders, optical sensitizers, dyes, ultraviolet absorbers, etc., and reference to such constituents can be found, for example, in Research Disclosure, Vol. 176, December 1978, Item 17643, Vol. 184, August 1979, Item 18431 and Vol 308, December 1989, Item 308119.

The photographic elements can be prepared by coating the light-sensitive silver halide emulsion layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene naphthalenate, polyethylene, polypropylene and other well known supports. Preferably, the silver halide emulsion layers are coated on the support at a total silver coverage of at least 1 g/m$^2$, preferably in the range of from 2 to 5 g/m$^2$.

Auxiliary layers can be represented by top-coating layers, antistatic layers, antihalo layer, protective layers, dye underlayers, and the like. Dye underlayers are particularly useful in order to reduce the cross-over of the double coated silver halide radiographic material. Reference to well-known dye underlayer can be found in U.S. Pat. No. 4,900,652, U.S. Pat. No. 4,855,221, U.S. Pat. No. 4,857,446, 4,803,150. According to a preferred embodiment, a dye underlayer is coated on at least one side of the support, more preferably on both sides of the support, before the coating of said at least two silver halide emulsions.

The radiographic element is associated with the intensifying screens so as to be exposed to the radiations emitted by the screens. The pair of screens employed in combination with the radiographic element is symmetrical or unsymmetrical. The screens are made of relatively thick phosphor layers which transform the X-rays into light radiation (e. g., visible light). The screens absorb a portion of X-rays much larger than the radiographic element and are used to reduce the radiation dose necessary to obtain a useful image.

The phosphors used in the intensifying screens have an emission maximum wavelength in the ultraviolet, blue, green, red or infrared region of the electromagnetic spectrum according to the region of the electromagnetic spectrum to which said at least two silver halide emulsion layers are sensitive. More preferably, said phosphors emit radiations in the ultraviolet, blue and green regions of the electromagnetic spectrum.

The green emitting phosphors emit radiation having more than about 80% of its spectral emission above 480 nm and its maximum of emission in the wavelength range of 530–570 nm. Green emitting phosphors which may be used in the intensifying screens include rare earth activated rare earth oxysulfide phosphors of at least one rare earth element selected from yttrium, lanthanum, gadolinium and lutetium, rare earth activated rare earth oxyhalide phosphors of the same rare earth elements, a phosphor composed of a borate of the above rare earth elements, a phosphor composed of a phosphate of the above rare earth elements and a phosphor composed of tantalate of the above rare earth elements. These rare earth green emitting phosphors have been extensively described in the patent literature, for example in U.S. Pat. Nos. 4,225,653, 3,418,246, 3,418,247, 3,725,704, 3,617,743, 3,974,389, 3,591,516, 3,607,770, 3,666,676, 3,795,814, 4,405,691, 4,311,487 and 4,387,141. These rare earth phosphors have a high X-ray absorbing power and high efficiency of light emission when excited with X radiation and enable radiologists to use substantially lower X radiation dosage levels.

The binder employed in the fluorescent layer of the intensifying screens can be, for example, one of the binders commonly used in forming layers: gum arabic, protein such as gelatin, polysaccharides such as dextran, organic polymer binders such as polyvinylbutyral, polyvinylacetate, nitrocellulose, ethylcellulose, vinylidene-chloride-vinylchloride copolymer, polymethylmethacrylate, polybutylmethacrylate, vinylchloride-vinyl-acetate copolymer, polyurethane, cellulose acetate butyrate, polyvinyl alcohol, and the like.

Generally, the binder is used in an amount of 0.01 to 1 part by weight per one part by weight of the phosphor. However, from the viewpoint of the sensitivity and the sharpness of the screen obtained, the amount of the binder should preferably be small. Accordingly, in consideration of both the sensitivity and the sharpness of the screen and the easiness of application of the coating dispersion, the binder is preferably used in an amount of 0.03 to 0.2 parts by weight per one part by weight of the phosphor. The thickness of the fluorescent layer is generally within the range of 10 $\mu$m to 1 mm.

The following examples, which further illustrate the invention, report some experimental data which show the stability to aerial oxidation, and the good sensitometric properties of the developer compositions of the present invention.

EXAMPLE 1

Ready-to-use photographic developer solutions (1 to 5) were prepared according to the following Table 1.

TABLE 1

| | 1 g/l | 2 g/l | 3 g/l | 4 g/l | 5 g/l |
|---|---|---|---|---|---|
| Water | 850 | 850 | 850 | 850 | 850 |
| KOH 35% w/w | 105 | 113 | 125 | 120 | 108 |
| Diethylene Glycol | 7.5 | 7.5 | 7.5 | 7.5 | 7.5 |
| 4-Morpholinomethane Di-phosphonic acid 40% w/w | 5.25 | 5.25 | 5.25 | 5.25 | 5.25 |
| EDTA acid | 1.5 | 1.5 | 1.5 | 1.5 | 1.5 |
| Sodium Metabilsulfite | 41.25 | 41.25 | 41.25 | 41.25 | 41.25 |
| Boric acid | 1.5 | 1.5 | 1.5 | 1.5 | 1.5 |
| Potassium bromide | 2.25 | 2.25 | 2.25 | 2.25 | 2.25 |
| Potassium carbonate | 12.5 | 12.5 | 12.5 | 12.5 | 12.5 |
| 5-Methyl-Benzotriazole | 0.06 | 0.06 | 0.06 | 0.06 | 0.06 |
| 1-Phenyl-5-Mercapto-tetrazole | 0.01 | 0.01 | 0.01 | 0.01 | 0.01 |
| Hydroquinone | 20 | / | / | / | / |
| Ascorbic acid | / | 32 | / | / | / |
| Metol | / | / | 30 | 30 | |
| Glycin | / | / | / | / | 30 |
| Dimezone S | 2.25 | 2.25 | 2.25 | / | 2.25 |
| pH at 20° C. | 10.70 | 10.70 | 10.70 | 10.70 | 10.70 |

Developer solution 1, containing hydroquinone as primary developing agent and Dimezone S as auxiliary developing agent, is a reference standard solution for developing X-ray silver halide materials. Developer solution 2, containing ascorbic acid as primary developing agent and Dimezone S as auxiliary developing agent, is a reference standard solution for developing X-ray silver halide materials. Developer solution 3 is a developer solution of the present invention, in which Metol is the primary developing agent is the primary developing agent and Dimezone S is the auxiliary developing agent. Developer solution 4, containing Metol as the only developing agent without auxiliary developing agent, is a comparison developing solution. Developer solution 5, containing Glycin (4-hydroxyphenylglycin) as primary developing agent and Dimezone S as auxiliary developing agent, is a comparison developing solution.

An X-ray silver halide emulsion layer was coated on each side of a subbed polyester support at a level of 2.15 g/m$^2$ of silver and 1.5 g/m$^2$ of gelatin per side. The emulsion comprised tabular silver bromide grains having an average diameter of 1.30 mm, an average thickness of 0.17 mm and an aspect ratio of 7.6, sulfur and gold chemically and spectrally sensitized to green light (Film A).

Samples of the above X-ray Film A were exposed and developed (at 35° C. and for 20 seconds) using developer solutions 1 to 4, then fixed at 35° C. for 20 seconds in an Imation APS fixing solution. Table 2 reports the sensitometric results.

TABLE 2

| Developer Solution | Dmin | Dmax | Speed | Toe Contrast | Average Contrast | Shoulder Contrast |
|---|---|---|---|---|---|---|
| 1 (reference) | 0.26 | 3.45 | 2.85 | 2.16 | 2.75 | 3.08 |
| 2 (reference) | 0.26 | 3.40 | 2.78 | 2.02 | 2.52 | 2.94 |
| 3 (invention) | 0.30 | 3.45 | 2.87 | 2.18 | 2.70 | 3.04 |
| 4 (comparison) | / | / | / | / | / | / |
| 5(comparison) | / | / | / | / | / | / |

Table 2 shows that developer solution 3 of the present invention, containing Metol as primary developing agent and Dimezone S as auxiliary developing agent, gave good sensitometric results when used to develop an X-ray film, the results being comparable to those obtained by standard X-ray developer solutions 1 and 2. Developer solution 3 showed a higher Dmin, due to the balancing of antifogging agents, which was that particularly suitable for the standards developing solutions. Comparison developing solution 4, containing Metol as the only developing agent, and comparison developing solution 5, containing Glycin as primary developing agent and Dimezone S as auxiliary developing agent, gave no acceptable sensitometric results (Dmax lower than 1.00).

EXAMPLE 2

Ready-to-use photographic developer solutions (6 and 7) were prepared following the compositions of developer solutions of Example 1, but changing the relative amounts of 5-methyl-benzotriazole and 1-phenyl-5-mercapto-tetrazole, tetrazole, which were in Example 1, respectively, 60 mg/l and 10 mg/l. Developer solution 6 had the composition of developer solution 3 of Example 1, but contained 11.8 mg/l of 5-methyl-benzotriazole and 40 mg/l of 1-phenyl-5-mercapto-tetrazole. Developer solution 7 had the composition of developer solution 1 of Example 1, but contained 11.8 mg/l of 5-methyl-benzotriazole and 25 mg/l of 1-phenyl-5-mercapto-tetrazole.

Samples of the same X-ray film of Example 1 were exposed, developed in developer solutions 1, 6 or 7, then fixed as described in Example 1. Table 3 reports the sensitometric results.

TABLE 3

| Developer Solution | Dmin | Dmax | Speed | Toe Contrast | Average Contrast | Shoulder Contrast |
|---|---|---|---|---|---|---|
| 1 (reference) | 0.26 | 3.45 | 2.85 | 2.16 | 2.75 | 3.08 |
| 6 (invention) | 0.26 | 3.44 | 2.84 | 2.15 | 2.77 | 3.12 |
| 7 (comparison) | 0.26 | 3.43 | 2.86 | 2.27 | 2.95 | 3.30 |

A correct balance of antifogging agents gave good Dmin also for the developing solution of the present invention.

EXAMPLE 3

Developer solutions 1, 2 and 3 of Example 1 were checked through the following test. Samples of 100 ml of each developer were put into an open glass calibrated flask (capacity 1000 ml) and the oxidation test through a continuous air contact was made in stressed conditions by the use of Dubnoff thermostatic bath at 38° C. and constant agitation for 8 hours/day. At regular intervals, pH values at 20° C. were measured.

The values of the pH for the developer solutions stored for different hours are reported hereinbelow in Table 4.

TABLE 4

| Developer Solutions | pH Values | | | |
|---|---|---|---|---|
| | Fresh | 24 hours | 48 hours | 72 hours |
| 1 (reference) | 10.70 | 11.32 | 12.03 | 12.27 |
| 2 (reference) | 10.70 | 9.49 | 9.02 | 8.82 |
| 3 (invention) | 10.70 | 11.30 | 11.66 | 11.50 |

The only solutions which did not show a pH decrease were the reference solution 1 having hydroquinone as primary developing agent and solution 3 of the present invention having Metol as primary developing agent.

EXAMPLE 4

A ready-to-use photographic developer solution (8) was prepared following the compositions of developer solution 3 of Example 1, but using 35 g/l of Dimezone S as primary developing agent and 5 g/l of Metol as auxiliary developing agent.

Samples of the same X-ray film of Example 1 were exposed, developed in developer solutions 1, 3 or 8, then fixed as described in Example 1. Table 5 reports the sensitometric results.

TABLE 5

| Developer Solution | Dmin | Dmax | Speed | Toe Contrast | Average Contrast | Shoulder Contrast |
|---|---|---|---|---|---|---|
| 1 (reference) | 0.26 | 3.45 | 2.85 | 2.16 | 2.75 | 3.08 |
| 3 (invention) | 0.30 | 3.45 | 2.87 | 2.18 | 2.70 | 3.04 |
| 8 (comparison) | 0.31 | 2.91 | 2.71 | 1.79 | 1.98 | 1.35 |

It is apparent from the results that developer solution 8, having Dimezone S as primary developing agent and Metol as auxiliary developing agent, gives poor sensitometric performances compared with the other developing solutions.

What is claims is:

1. A black-and-white aqueous alkaline photographic developer composition comprising a p-aminophenol primary developing agent and an auxiliary superadditive 3-pyrazolidone developing agent wherein the p-aminophenol developing agent is present in an amount from about 0.08 to about 0.3 moles per liter and is represented by the formula:

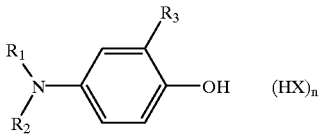

wherein $R_1$ and $R_2$, which may the same or different, each represents a hydrogen atom, an alkyl group, or $R_1$ and $R_2$ together represent the carbon atoms required to complete a 5-membered saturated ring; $R_3$ represents a hydrogen atom, an alkyl group or an alkoxy group; n represents 0 or 1; and HX represents HCl or ½ $H_2SO_4$, wherein the black-and-white photographic developer composition is dihydroxybenzene free.

2. The black-and-white aqueous alkaline photographic developer composition of claim 1 wherein said p-aminophenol primary developing agent is p-methylaminophenol sulfate.

3. The black-and-white aqueous alkaline photographic developer composition of claim 1 wherein said auxiliary superadditive 3-pyrazolidone developing agent is represented by the formula:

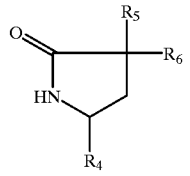

wherein $R_4$ represents a phenyl group; and $R_5$ and $R_6$, which may be the same or different, each represents a hydrogen atom or an alkyl group.

4. The black-and-white aqueous alkaline photographic developer composition of claim 1 wherein said auxiliary superadditive 3-pyrazolidone developing agent is selected from the group consisting of 1-phenyl-3-pyrazolidone, 1-phenyl-4,4-dimethyl-3-pyrazolidone and 1-phenyl-4-methyl4-hydroxymethyl-3-pyrazolidone.

5. The black-and-white aqueous alkaline photographic developer composition of claim 1 wherein the amount of said auxiliary 3-pyrazolidone developing agent is from about 0.001 to 0.2 moles per liter.

6. The black-and-white aqueous alkaline photographic developer composition of claim 1 wherein the molar ratio of p-aminophenol and 3-pyrazolidone developing agents is from 4 to 10.

7. The black-and-white aqueous alkaline photographic developer composition of claim 1, additionally comprising a buffering agent selected from the group consisting of carbonate compounds, borate compounds, and mixtures thereof.

8. The black-and-white aqueous alkaline photographic developer composition of claim 1, additionally comprising an antifogging agent which is an alkali metal halide.

9. The black-and-white aqueous alkaline photographic developer composition of claim 1, additionally comprising an antifogging agent selected from the group consisting of benzotriazole compounds, tetrazole compounds, and mixtures thereof.

10. The black-and-white aqueous alkaline photographic developer composition of claim 1, additionally comprising an antioxidant compound which is an alkali metal sulfite.

11. The black-and-white aqueous alkaline photographic developer composition of claim 1, additionally comprising a sequestering agent selected from the group consisting of aminopolycarboxylic acid compounds, α-hydroxycarboxylic acid compounds, dicarboxylic acid compounds, polyphosphate compounds and dialkylamino methane diphosphonic acid compounds.

12. A black-and-white aqueous alkaline photographic developer composition comprising (a) a p-aminophenol primary developing agent present in an amount of about 0.08 to about 0.3 moles per liter;

(b) an auxiliary superadditive 3-pyrazolidone developing agent present in an amount of 0.001 to 0.2 moles per liter;

(c) an inorganic antifogging agent present in an amount of 0.001 to 0.2 moles per liter;

(d) an antioxidant compound present in an &mount of 0.001 to 1 moles per liter;

(e) a buffering compound present in an amount of 0.1 to 1.5 moles per liter;

(f) a sequestering agent present in an amount of 0.0001 to 0.2 moles per liter;

(g) an organic antifogging agent present in an amount of $1\times10^{-5}$ to $5\times10^{-2}$ moles per liter;

(h) an inorganic alkali agent to adjust the pH to a range of 9 to 13; and (i) water to make one liter.

13. The black-and-white aqueous alkaline photographic developer composition of claim 12 wherein the pH value is in the range of 10 to 11.

14. A process for forming a black-and-white photographic silver image comprising the steps of (1) imagewise exposing a silver halide photographic element and (2) developing the exposed element, said developing being effected with a dihydroxybenzene free black-and-white aqueous alkaline photographic developer composition comprising a p-aminophenol primary developing agent and an auxiliary superadditive 3-pyrazolidone developing agent, wherein the p-aminophenol primary developing agent is present in an amount from about 0.08 to about 0.3 moles per liter and is represented by the formula:

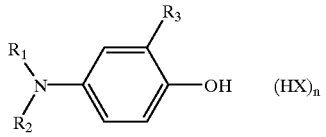

wherein $R_1$, and $R_2$, which may be the same or different, each represents a hydrogen atom, an alkyl group, or $R_1$ and $R_2$ together represent the carbon atoms required to complete a 5-membered saturated ring; $R_3$ represents a hydrogen atom an alkyl group or an alkoxy group; n represents 0 or 1; and HX represents HCl or ½ $H_2SO_4$.

* * * * *